US008887464B1

(12) United States Patent
Smith, Jr.

(10) Patent No.: US 8,887,464 B1
(45) Date of Patent: Nov. 18, 2014

(54) METAL PANEL ROOF RECOVER

(76) Inventor: Charles L. Smith, Jr., Houston, TX (US)

( * ) Notice: Subject to any disclaimer, the term of this patent is extended or adjusted under 35 U.S.C. 154(b) by 16 days.

(21) Appl. No.: 13/573,282

(22) Filed: Sep. 7, 2012

Related U.S. Application Data

(60) Provisional application No. 61/552,853, filed on Oct. 28, 2011.

(51) Int. Cl.
*E04B 1/62* (2006.01)

(52) U.S. Cl.
USPC ..... 52/395; 52/336; 52/466

(58) Field of Classification Search
CPC ..... E04D 3/30; E04D 3/362; E04D 3/364; E04D 3/366
USPC ..... 52/66, 90.2, 198, 309.4, 336, 395, 459, 52/463, 465, 466, 469, 520, 528, 537
See application file for complete search history.

(56) References Cited

U.S. PATENT DOCUMENTS

| | | | | | |
|---|---|---|---|---|---|
| 4,089,145 | A | * | 5/1978 | DeVries et al. | 52/461 |
| 4,099,356 | A | * | 7/1978 | Graham | 52/520 |
| 4,213,282 | A | * | 7/1980 | Heckelsberg | 52/404.2 |
| 4,217,741 | A | * | 8/1980 | Cole | 52/520 |
| 4,476,658 | A | * | 10/1984 | Johnstone | 52/395 |
| 4,575,983 | A | | 3/1986 | Lott, Jr. et al. | |
| 4,649,684 | A | | 3/1987 | Petree et al. | |
| 5,134,825 | A | * | 8/1992 | Berridge | 52/520 |
| 5,367,848 | A | | 11/1994 | McConnohie | |
| 5,737,892 | A | | 4/1998 | Greenberg | |
| 6,354,045 | B1 | | 3/2002 | Boone et al. | |
| 6,796,097 | B2 | | 9/2004 | Fensel et al. | |
| 8,061,087 | B2 | | 11/2011 | Ray | |
| 2009/0126303 | A1 | * | 5/2009 | Ferge et al. | 52/410 |
| 2010/0275525 | A1 | * | 11/2010 | Wendelburg et al. | 52/90.2 |
| 2011/0016803 | A1 | * | 1/2011 | Ray | 52/90.2 |

OTHER PUBLICATIONS

Ask Todd Miller *Metal Roofing Expert, *Exsposed Fastener Metal Roofing: Is it Standing Seam*? http://www.asktoddmiller.com/history/exposed-fastener-metal-roofing-is-it-standing-seam/ (Apr. 6, 2013).

D. McKinnis, *Just What is a Standing Seam Metal Roof*? http://www.mckinnisroofinf.com/residential-roofing/just-what-is-a-standing-seam-metal-roof/ (Aug. 3, 2011).

wiseGEEK, *What is Standing Seam Roofing*? http://www.wisegeek.com/what-is-standing-seam-roofing.htm.

* cited by examiner

*Primary Examiner* — Charles A Fox
*Assistant Examiner* — James Buckle, Jr.
(74) *Attorney, Agent, or Firm* — Keith B. Willhelm

(57) ABSTRACT

The subject invention provides for metal panel roof recover systems which are installed over an existing roof. The existing roof has a support frame which includes an array of spaced purlins running horizontally through the roof and a plurality of interconnected metal panels that are mounted vertically across the array of purlins. The roof recover system comprises individual panel clips, elongated panel clips, and a metal cover. The individual clips are arranged in linear arrays running vertically across the purlins and are mounted to the purlins through the panels of the existing roof. The elongated continuous panel clips extend vertically across and are mounted to adjacent purlins through the panels of the existing roof. The metal cover is attached to the clips and comprises a plurality of metal panels interconnected by vertical standing seams formed on the clips.

29 Claims, 10 Drawing Sheets

METAL PANEL ROOF RECOVER

CLAIM TO PRIORITY

This application claims priority of U.S. provisional application Ser. No. 61/552,853, filed Oct. 28, 2011, the disclosure and drawings of which are incorporated herein in their entirety by reference.

FIELD OF THE INVENTION

The present invention relates to metal panel roof covers and, more particularly, to metal panel roof covers for installation over an existing metal roof.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. More typically, however, metal roof covers utilize rather elongated metal panels installed along the slope of a roof.

Metal panel roofs utilize various flashings and other components where the fields of a roof terminate or intersect, such as the eaves, gables, valleys, ridges, and hips of a roof. Even in roofs having many different intersecting or overlapping fields, however, the basic construction of metal panel roofs across the expanse of a roof is fairly standard. Most commonly, an array of spaced, elongated support members or "purlins" is mounted across the structural rafters of a roof substructure. The purlins run horizontally across the rafters, i.e., across the slope of the roof. Layers of insulation and various barriers may be, and for climate controlled buildings usually are installed. Decking also may be provided for additional support. A cover is provided by a series of rather elongated, mostly flat, interconnected metal panels.

Each cover panel is typically a few feet in width. The lateral edges of the panels are bent in various configurations to form upwardly extending sides and a trough in the middle. The trough is where most of the water will be shed from the roof. Adjacent panels are joined along their upwardly extending sides to create relatively narrow seams which are elevated above the trough. The panels are laid out such that the seams run vertically, i.e., with the slope of the roof. The panels also may have one or more vertical ridges running through the trough, and it is those vertical seams and ridges that create the distinctive appearance that consumers associate with metal roofs. More importantly, however, since the seams between adjacent panels are formed a few inches above the troughs where most rain will be shed, metal panel roofs can be very resistant to leaking.

One common type of metal panel roof is characterized by its use of screws or other fasteners that penetrate through the cover panels. Such "through panel" or "exposed" fastener roofs typically use panels, such as "R" panels, that have raised, overlapping longitudinal sides. The panels are laid over a roof so that their sides overlap and form a raised, trapezoidally shaped seam or "lap" rib. The panels then are joined together along the lap rib by, e.g., gasketed screws. Gasketed screws also are driven through the trough to fasten the panels to the purlins. Leakage around the fastener, at least initially, is not a significant problem. Over time, however, the elastomeric material from which the screw gaskets are fabricated can deteriorate, and leaks tend to develop around penetrating fasteners.

Another common type of roof panel is the so-called "standing seam" metal panel. Standing seam metal panel covers can provide better resistance to leakage over longer periods of time even for flat roofs where ponding water is a concern and, in the eyes of many beholders, provide a more beautiful roof. Standing seams use concealed clips to secure the panels to the underlying purlins instead of unsightly and leak-prone penetrating fasteners. For example, individual panel clips may be installed in vertical lines from one purlin to the next along what will become a seam line between panels. Panels are then installed between the vertical lines of clips, with the upturned seam edges of the panels abutting and mating with the clips and each other. There are no penetrations through the panels when clips are used. Moreover, all gaps between the panels and the clips are elevated well above the trough through which most water runoff occurs. Thus, standing seam panel covers provide better, longer resistance to leakage as compared to covers using screws or other "through panel" fasteners that penetrate the panels.

Providing adequate uplift resistance, however, can be a greater challenge in standing seam panel covers. That is, most damage to roof covers is caused by wind blowing over the surface of the roof. That air flow forms low pressure areas over the roof and creates an uplift force in much the same way that the wing of an aircraft creates lift forces. While such forces are essential for flight, the uplift forces created by powerful winds over a roof can peel metal panels or other roof coverings away from the roof. It is relatively easy to provide a sufficient number of fasteners in exposed fastener covers. Since they are connected only along their seam lines, however, providing a sufficiently secure connection for panels in a standing seam cover is more problematic.

In addition, not all parts of a roof experience the same uplift forces in a given wind. The exposed edges of a roof experience greater uplift forces, and a given surface or field of a roof may be divided into three zones in recognition of such differences. The "edge" zones include those areas within a certain distance, usually around 8 feet, of an eave or gable. If the pitch of a roof is greater than 2 inches per foot of slope, the areas adjacent the ridge and hip of the roof also are considered "edge" zones. The edge zones experience greater wind uplift pressures than most of the roof and typically constitute approximately 15% of a roof's surface. The greatest uplift pressures, however, are in the "corner" zones. Those are the areas where edge zones overlap, and they typically constitute approximately 5% of the surface of a roof. The "field" zone is the rest of the roof field and it constitutes approximately 80% of the roof surface. The field zone experiences the lowest wind uplift pressures. In any event, providing sufficient resistance to wind uplift has been an increasingly important consideration in roof design as property owners and insurers seek to minimize their potential losses from wind damage, especially in hurricane prone areas like the Gulf and lower Atlantic coast.

Examples of standing seam roof covers using non-penetrating clips are disclosed in U.S. Pat. No. 4,575,983 to H. Lott, Jr. et al. The panels disclosed therein are asymmetrical standing seam panels. Asymmetrical panels have mating male-female connections, each panel having a male connection formed in one side and a female connection formed in its other side. Thus, installation must proceed in a certain direction across the roof and removal for repair must proceed in the opposite direction.

Symmetrical standing seam panels, however, have sides which are identical and are joined with a separate seam cover. Symmetrical panels, therefore, may be installed in either direction. A damaged panel also may be removed for replacement without removing any adjacent panels. Examples of symmetrical standing seam roof covers using non-penetrating individual clips are disclosed in U.S. Pat. No. 4,649,684 to L. Petree et al. Other covers, such as those disclosed in U.S. Pat. No. 6,354,045 to M Boone et al. and U.S. Pat. No. 5,737,892 to P. Greenberg, utilize individual and elongated, "continuous" clips that are mounted to and span adjacent purlins. While they are more costly than covers using asymmetrical panels, such symmetrical panel covers can offer improved leak protection, better uplift resistance, and longer service life.

Despite the improvements in both the quality of panels and methods of installation, however, many of the metal roofs installed in the past twenty to thirty years have deteriorated to the point where they must be replaced. That is especially true for exposed fastener metal panel covers having, as they do, fasteners that penetrate the panels. Such covers have been widely installed and constitute the vast majority, perhaps in excess of 90% of the metal roof covers in existence today, and many of them are leaking. Removing an existing roof, however, is expensive and highly disruptive for occupants of a building. It also creates large quantities of waste that must be disposed of, and eliminates not only the existing roof, but whatever insulation value the existing roof may have provided. Thus, various covers have been developed to essentially recover an existing roof.

The most economical fix is to simply apply a plastic coating to the roof. Any exposed fasteners, along with seams, penetrations, flashing and the like, typically are caulked or covered with a fabric tape. All surfaces then are primed and the coating, usually a water based acrylic elastomer or a solvent-based butyl rubber or silicone rubber, is applied. Coatings have limited service lives, but have a great cost advantage.

So-called "single ply" covers offer a somewhat better solution at somewhat higher, but still relatively low cost. Rigid foam panels are laid between the seams of the existing metal panel roof. A recovery board, usually plywood, particle board, oriented strand (OSB) board, or fiber reinforced gypsum board, is installed over the foam panels. A rubber sheet, such as an ethylene propylene diene monomer (EPDM), thermoplastic polyolefin (TPO), polyvinyl chloride (PVC), ketone ethylene ester (KEE), such as Elvaloy™, is then adhered to the recovery board.

Another approach has been to install new metal panels over existing metal panel roofs. Installing a new metal cover, or "recover" over an existing cover offers significantly longer service life. Nevertheless, because that extended service life come with a much greater cost, metal panel recovers remain at a significant disadvantage relative to cheaper alternatives.

That increased cost is derived largely from the complexity of standing seam metal recovers and the cost of their various components. For example, standing seam metal recovers most commonly require the installation of new purlins over the existing roof panels. The new purlins then provide a base to which new panels may be attached, either with exposed fasteners or with clips.

In one common recover, for example, brackets are attached to the existing purlins, and a new purlin is mounted on the brackets above each existing purlin. A simpler recover, such as that disclosed in U.S. Pat. No. 5,367,848, uses notched purlins, the notches accommodating the seams and ridges in existing panels so that new purlins may be attached directly to existing purlins without brackets. Needlessly complicated recovers also have been devised, however, such as those disclosed in U.S. Pat. No. 8,061,087 to G. Ray. The recovers disclosed in Ray '087 require the installation of even more purlins above and between the purlins in the existing roof. In any event, new panels are attached to the new purlins, preferably with panel clips.

Individual clips also have been used to install new asymmetrical standing seam panels over existing standing seam metal roofs without installing new purlins. The clips in those recovers are installed on top of the existing metal panels and are mounted to the purlins of the existing roof. Such an approach can offer significant material savings, but it has its drawbacks. Some of the material savings derived by eliminating new purlins is offset by the increased material cost of the clips. Other factors being equal, such clips necessarily will be taller than clips designed for mounting atop new purlins. Such recovers also provide limited wind uplift resistance.

It also may not always be practical or feasible to attached individual clips to existing purlins. If the surface of existing panels are uneven, it may be difficult to align an array of individual clips, extending as it typically will in a relatively long run, even with shims. Insulation also may be installed between the purlins and panels in an existing roof. The presence of such insulation not only makes it more likely that an aging roof will have surface irregularities, but it also may mean that the existing roof cannot provide adequate support for individual panels clips. That is especially true as the thickness of an insulation layer increases and its load capacity decreases. For example, relatively small horizontal forces applied to the top of a clip can generate high torque loads when the clip is separated from a purlin by thick, soft insulation.

Metal recovers commonly create space between the existing panels and new panels which may be filled with insulating material. The insulation typically is a fibrous batt or rigid foam board. While greatly improving the insulation value of a recover, such insulation creates its own set of structural problems. That is, recover panels preferably are supported such that they have sufficient load capacity to accommodate a worker walking over the roof. If they are not adequately supported, recover panels may collapse or transmit damaging stress to their seams.

Any system for installing a new metal panel roof cover, of course, also must provide sufficient wind uplift resistance. Moreover, all components should be designed with consideration of not only the cost of manufacturing the component, but also in view of how easily the component and the overall system may be installed and repaired. Material and labor costs are a major component of any roofing project. This is especially critical because there are so many cheaper, albeit less effective, recovering systems on the market.

Accordingly, there remains a need for new and improved systems, apparatus and methods for installing metal panels over existing metal roofs. Such disadvantages and others inherent in the prior art are addressed by various aspects and embodiments of the subject invention.

SUMMARY OF THE INVENTION

The subject invention, in its various aspects and embodiments, is directed generally to metal panel roof "recovers," that is, metal panel roof covers that are installed over an existing roof. One aspect of the invention provides for a metal panel roof recover system which is installed over an existing roof. The existing roof has a support frame which includes an array of spaced purlins running horizontally through the roof and a plurality of interconnected metal panels that are mounted vertically across the array of purlins. The roof recover system comprises individual panel clips, elongated panel clips, and a metal cover. The individual clips are arranged in linear arrays running vertically across the purlins and are mounted to the purlins through the panels of the existing roof. The elongated continuous panel clips extend vertically across and are mounted to adjacent purlins through the panels of the existing roof. The metal cover is attached to the clips and comprises a plurality of metal panels interconnected by vertical standing seams formed on the clips. The clips support the cover panels above the panels in the existing roof.

Another aspect of the invention provides for a metal panel roof recover system comprising rigid foam insulation boards, panel clips, and a metal cover. The rigid foam insulation boards are supported on the existing roof. A plurality of panel clips are supported on the insulation boards and mounted to the purlins by fasteners extending through the insulation boards. The metal cover is attached to the panel clips and comprises a plurality of metal panels interconnected by vertical standing seams formed on the panel clips.

Yet other aspects provide for a metal panel roof recover system comprising rigid foam insulation boards, panel clips, and a metal cover. The rigid foam insulation boards are supported on the existing roof. A plurality of panel clips are supported on bearing plates which are supported on the insulation boards and mounted to the purlins by fasteners extending through the bearing plates and insulation boards. The metal cover is attached to the panel clips and comprises a plurality of metal panels interconnected by vertical standing seams formed on the panel clips.

Still other aspects of the subject invention provide for a method of installing a metal cover over an existing roof. The existing roof has a support frame which includes an array of spaced purlins running horizontally through the roof and a plurality of interconnected metal panels mounted vertically across the array of purlins. The method comprises mounting individual panel clips to the purlins through the panels of the existing roof. The panel clips are arranged in linear arrays running vertically across the purlins in a first area of the existing roof. Elongated continuous panel clips are mounted to adjacent purlins through the panels of the existing roof, the continuous panel clips extending vertically across the purlins in a second area of the existing roof. The method then comprises installing metal recover panels on the clips and interconnecting the metal recover panels to provide a cover over the existing roof by forming standing seams on the panel clips.

Another aspect provides for a method of installing a metal cover over an existing roof. The method comprises installing rigid foam insulation boards on the existing roof. Panel clips then are mounted to the purlins through the insulation boards. The method further comprises installing metal panels on the clips and interconnecting the metal panels to provide a cover over the existing roof by forming standing seams on the panel clips.

Yet other aspects provide recovers and recover methods where the vertical standing seams comprise a seam cover and where the individual panel clips are installed in a field zone of the existing roof and the continuous panel clips are installed in an edge or a corner zone of the existing roof.

Still further aspects of the subject invention provide for recovers and recover methods where the panel clips or any bearing plates are disposed in grooves or other recesses in the insulation boards and where the insulation boards have a lower profile matching an upper profile of the existing roof panels.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

While the description and drawings that follow necessarily are directed to particular embodiments, they shall not be understood as limiting the scope of the invention. They are included to provide a better understanding of the invention and the manner in which it may be practiced. The subject invention encompasses other embodiments consistent with the claims set forth herein.

Figure 1:
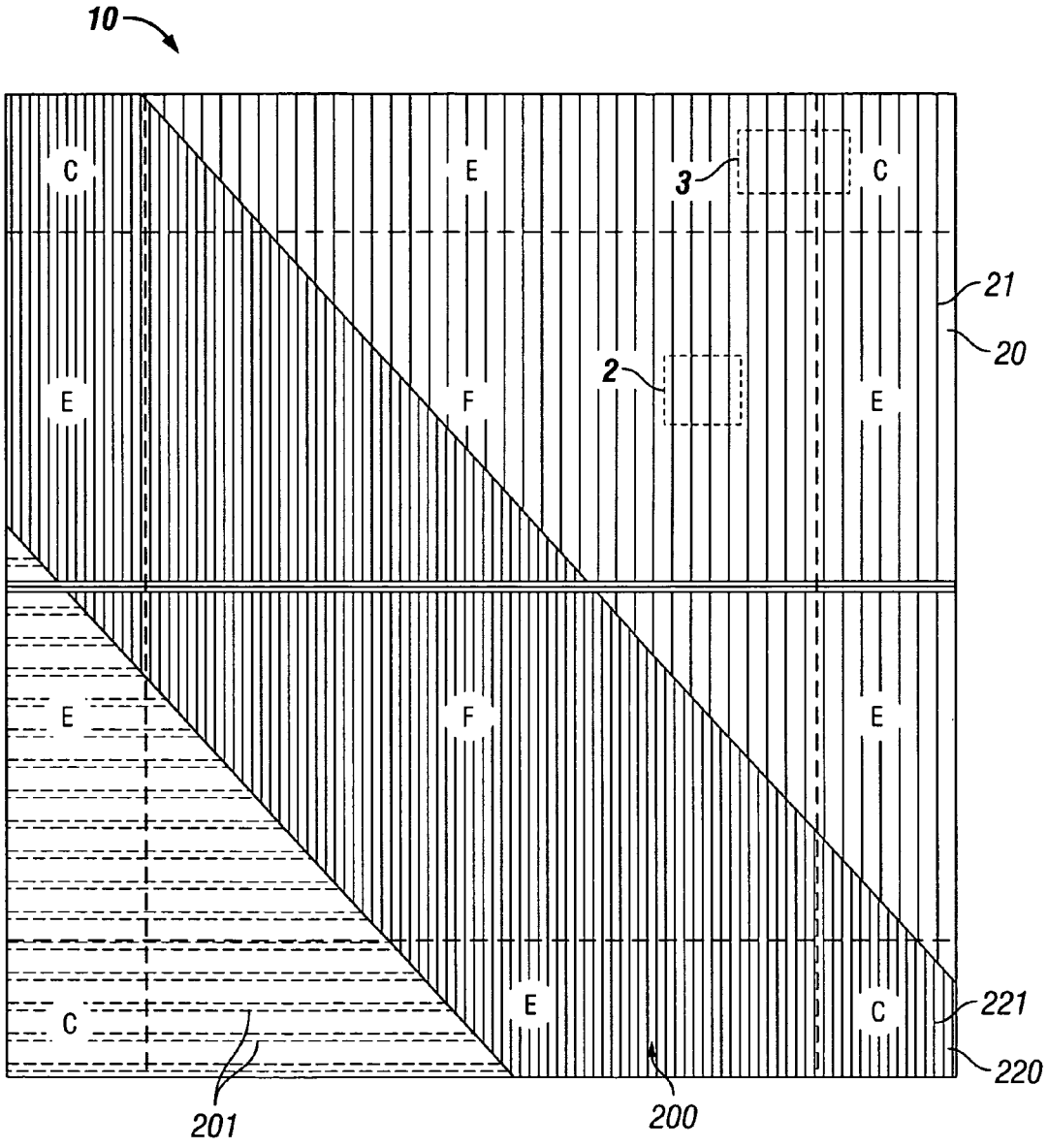
FIG. 1 is a perspective view, including partial tear-away views, of a conventional metal panel roof 200 which has been recovered with a first preferred embodiment 10 of the metal panel roof recovers of the subject invention.

In the drawings and in the description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to metal panel roof covers for installation over an existing roof, that is, to metal panel roof "recovers." The novel metal panel roof recovers may be installed over an existing roof, such as prior art metal roof 200 shown in FIGS. 1-5.

Existing roof 200 is installed over a relatively flat roof support frame (not shown), that it, it is a "structural" roof cover. Structural metal panels are most commonly used over relatively low slope roofs, although even "flat" roofs preferably have a minimum of 0.25 inch per foot of slope to provide runoff. A structural panel roof cover can support its own weight without a deck since the metal panels have higher seams, usually from 2 to 3 inches. The seams of a structural cover are hydrostatic. That is, they are designed to be water tight since the seams may have to withstand pressure from ponding water.

The novel metal panel roof recovers, however, also may be installed over existing "architectural" roof covers. Architectural metal panels are generally installed over relatively steep roofs, those having a minimum slope of about 3 inches per foot of slope, where visual impact or aesthetics may be more valued. Panel seams in architectural metal panel roofs are hydrokinetic, i.e., water shedding. Since the seams are relatively short, usually 0.5 to 1.5 inches high—a supporting deck usually is installed over the roof rafters to provide support for the panels.

Existing roof 200 is typical of exposed fastener metal roofs that have been installed in great numbers over the past few decades. As shown generally therein, it includes an array of spaced, elongated bar joists or purlins 201. Purlins 201 are mounted on structural rafter beams (not shown) of a roof substructure and run "horizontally" through the roof. That is, purlins 201 are installed and run across the slope of a roof, as opposed to running "vertically" or with the slope.

Purlins 201 are "Z" purlins of the type widely used in metal roofs and building covers. As seen best in FIGS. 2-3, purlins 201 of existing roof 200 have a flange 202 extending generally horizontally in one direction from the lower end of a vertically oriented body 203. Another flange 204 extends generally horizontally in the other direction from the upper end of body 203. Lower flange 202 provides a base by which purlins 201 are attached to the rafter beams (not shown). Upper flange 204 provides a surface upon which is mounted a series of overlapping elongated panels 220.

Panels 220 in existing roof 200 run vertically across purlins 201 and have upturned longitudinal sides that overlap to form raised lap ridges 221. Existing panels 220 also have, as is typical of panels of this type, a number of vertical ridges 226 formed in the trough 222 extending between lap ridges 221. Panels 220 are supported by and attached to upper flange 204 of purlins 201 by penetrating fasteners, such as screws (not shown), which are installed in the troughs 222 of panels 220. Panels 220 also are interconnected by screws or other penetrating fasteners (not shown) installed along overlapping lap ridges 221.

The novel metal panel roof recovers will be described in relation to metal roofs in general and to existing metal roof 200 in particular. It is to be understood, however, that the novel roof recovers may be installed over other types of existing roofs, such as rubber roofs, without departing from the principles of the present invention.

Various preferred embodiments of the novel metal panel roof recovers comprise individual panel clips and elongated continuous panel clips that are mounted to purlins in an existing metal roof. The individual panel clips are arranged in linear arrays running vertically across the purlins and are mounted to the purlins through the panels of the existing metal roof. The continuous panel clips extend vertically across and are mounted to adjacent purlins through the panels of the existing roof. A metal cover is attached to the clips. The metal cover comprises a plurality of metal panels interconnected by vertical standing seams formed on the clips. Since the panel clips are mounted to the purlins of the existing roof, the novel roof recovers may be installed on an existing roof without the need for additional purlins or by any other additional component designed to connect a panel clip to an existing roof system.

Figure 2:
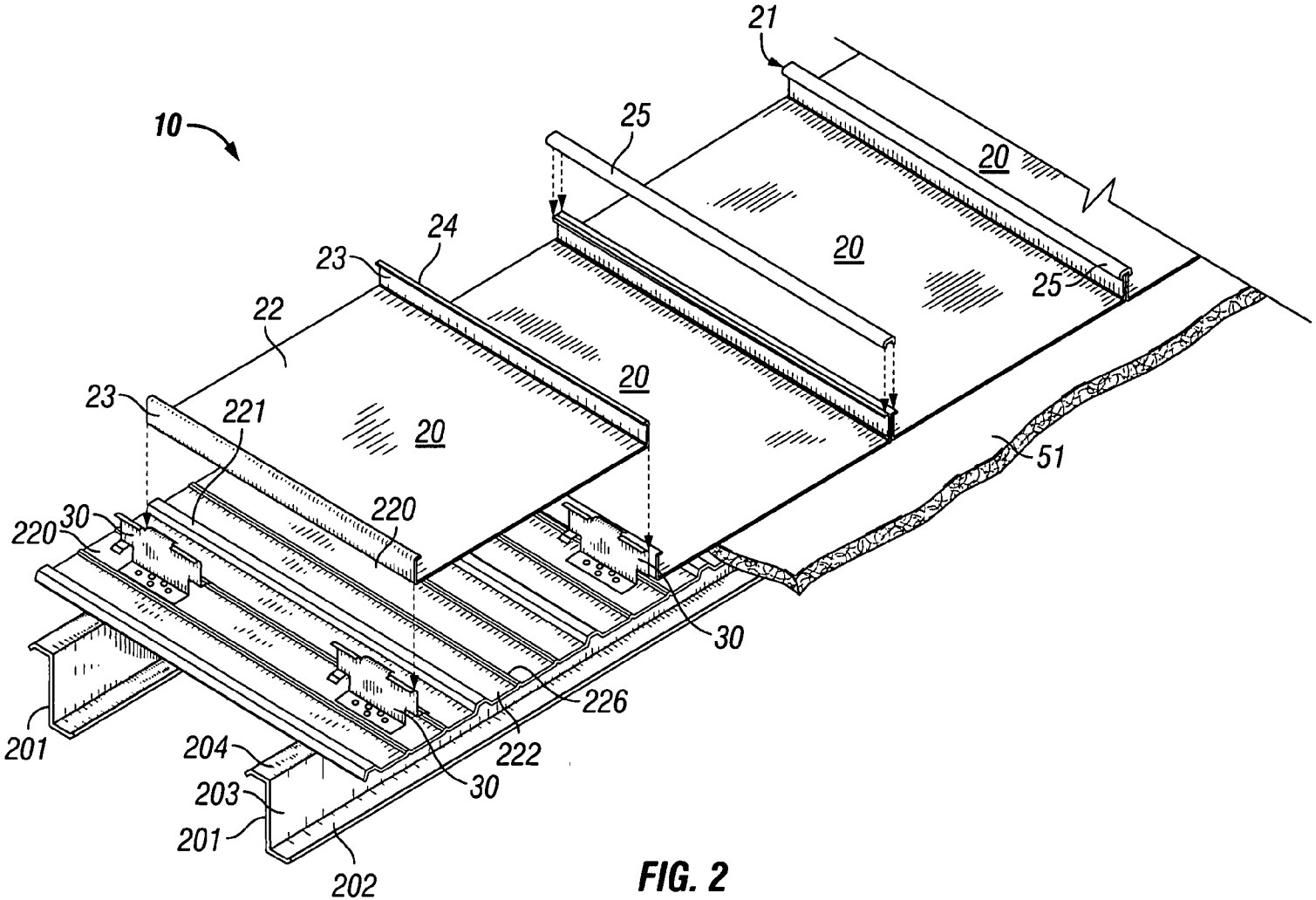
FIG. 2 is a partially exploded perspective view of a portion of novel roof recover 10 taken generally from an area 2 of FIG. 1, which portion of novel roof recover 10 has been installed over field zone F of conventional roof 200.
Figure 3:
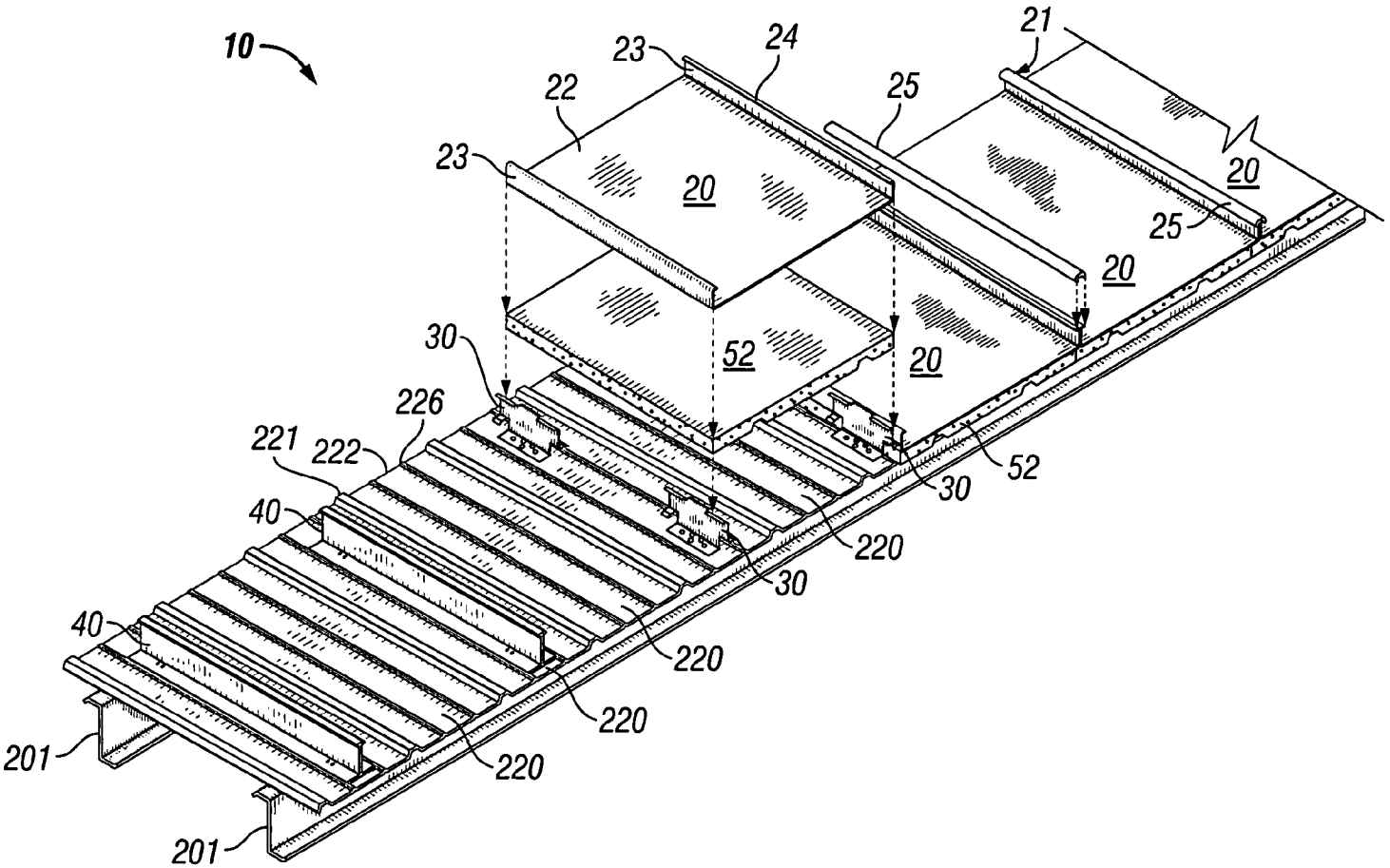
FIG. 3 is a perspective, partially exploded view, similar to the view of FIG. 2, of a portion of novel roof recover 10 taken generally from an area 3 of FIG. 1, which portion has been installed across a boundary between edge zone E and corner zone C of conventional roof cover 200 (certain components of novel roof recover 10 having been omitted therefrom)
Figure 4:
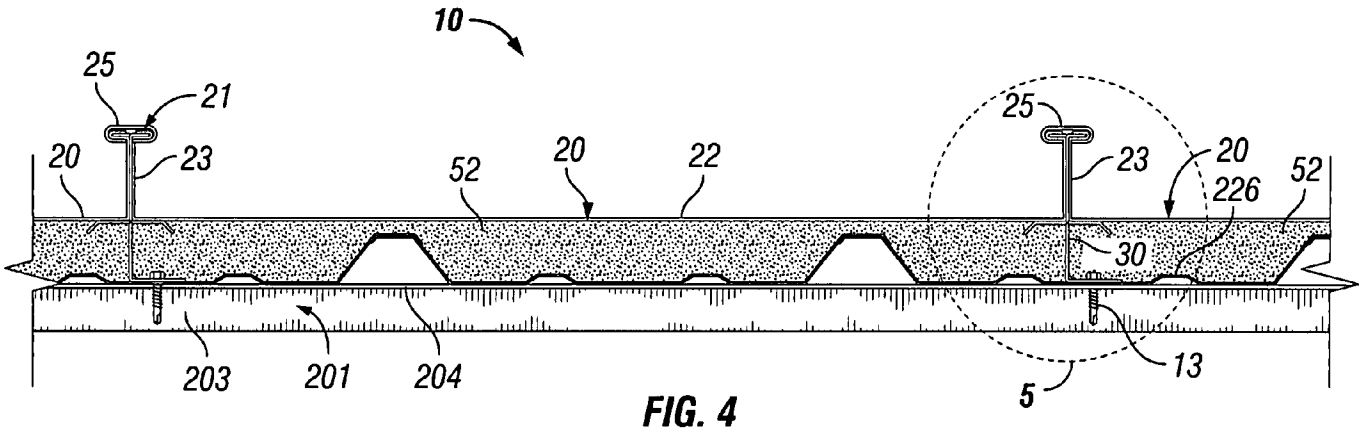
FIG. 4 is a cross-sectional view taken along line 4-4 of FIG. 2 of novel roof recover 10.
Figure 5:
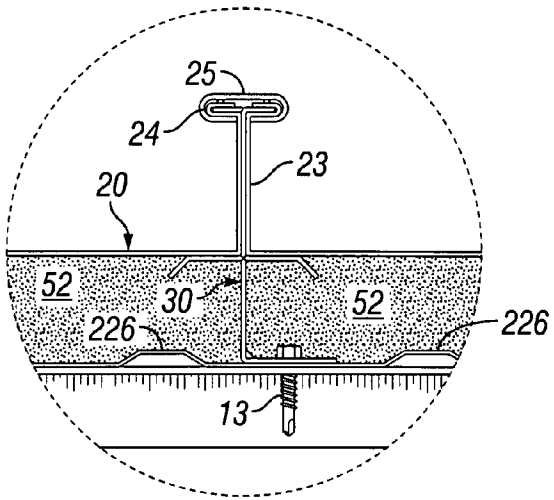
FIG. 5 is an enlarged, detailed view of portion 5 of the view shown in FIG. 4.

For example, preferred novel roof recover 10 generally comprises roof recover panels 20, individual clips 30, and continuous clips 40. As shown in FIGS. 1-3, recover panels 20 run vertically and are interconnected along their lateral edges by standing seams 21. Standing seams 21 define troughs 22 through which water is shed from roof 10. The upper ends of recover panels 20 extend under a ridge cap 11 provided along a peak line 12 of roof 10. Preferably, each recover panel 20 runs down the entire slope of roof 10 to an eave or valley (not shown). Alternately, the troughs may be provided by two or more panels overlapped at their ends.

The panels used in the novel recover metal roofs are the same type of standing seam panels as are conventionally used in metal panel roof covers. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. Preferably, the former is mounted on a trailer or truck so that panels may be fabricated on a job site.

Panel clips are used to secure recover panels to an existing roof and to facilitate the formation of standing seams between the recover panels. Individual clips 30 and continuous clips 40, for example, are used to secure recover panels 20 over existing roof 200 and to facilitate the formation of seams 21 between adjacent panels 20 as shown in FIGS. 2-5. They are disposed on the upper surface of existing panels 220 along the vertical seam lines between recover panels 20 and are attached by fasteners, such as screws 13, to purlins 201 in existing roof 200. If there is any sag in an existing metal roof 200, shim plates (not shown) may be provided under clips 30 and 40 so that they are aligned more or less in the same plane.

In addition, various barrier sheets, films, and coatings may be provided over existing panels 220, if desired, to provide a vapor barrier, to reflect radiant heat, or to provide fire resistance.

Preferred embodiments of the subject invention include metal panel roof recovers in which individual panel clips are installed in the field of an existing roof and continuous clips are installed in corner zones, and where either individual or continuous clips are installed in edge zones of the existing roof. For example, novel roof recover 10 includes large field zones F, edge zones E, and corner zones C as shown in FIG. 1. Individual panel clips 30 are installed in field zones F and edge zones E and continuous clips 40 are installed in corner zones C. That may be best appreciated by reference to FIG. 2, which is a section of novel recover roof 10 installed in a field zone F, and FIG. 3, which is a section of novel roof 10 installed across a boundary between an edge zone E and a corner zone C.

As exemplified therein, individual clips 30 are mounted on panels 220 of existing roof 200 in linear arrays. The arrays of individual clips 30 run vertically through field zones F and edge zones E of existing roof 200 along what will become the seam lines for recover panels 20. Thus, the linear arrays of clips 30 are separated horizontally by a distance substantially equal to the width of recover panels 20.

Continuous clips 40 are installed in corner zones C of roof 200. Like individual clips 30, continuous clips 40 are mounted along the seam lines for recover panels 20 and thus are offset from each other by a distance approximately equal to the width of panels 20. In contrast to individual clips 30, however, continuous clips 40 are elongated and extend across adjacent purlins 201 in existing roof 200. Continuous clips 40, therefore, provide continuous support for panels 20 through corner zones C, thus providing greater resistance to wind uplift in those areas experiencing the greatest uplift forces.

If desired or necessary, increased resistance to wind uplift may be provided in roof edge zones by providing continuous clips in those zones instead of individual clips as in recover roof 10. Similarly, in those zones where they are employed, individual clips typically will be installed on every purlin along the seam line as are clips 30 in recover roof 10. If resistance to wind uplift is not a great concern, however, it may not be necessary to install an individual clip on every purlin. It also will be appreciated that continuous clips preferably extend across the entire corner zones or, if employed therein, the edge zones of a roof. Shorter continuous clips may be employed, however, and arranged in a line across the zone such that their ends overlap, abut, or are spaced somewhat apart with the result that support for recover panels is provided across substantially the entire run through the zone. In any event, by selectively installing either individual or continuous clips across the roof, it is possible to provide a standing seam roof recover with increased resistance to wind uplift in those areas requiring greater resistance, yet which requires fewer parts, may be installed more easily, and has lower material costs.

Figure 6:
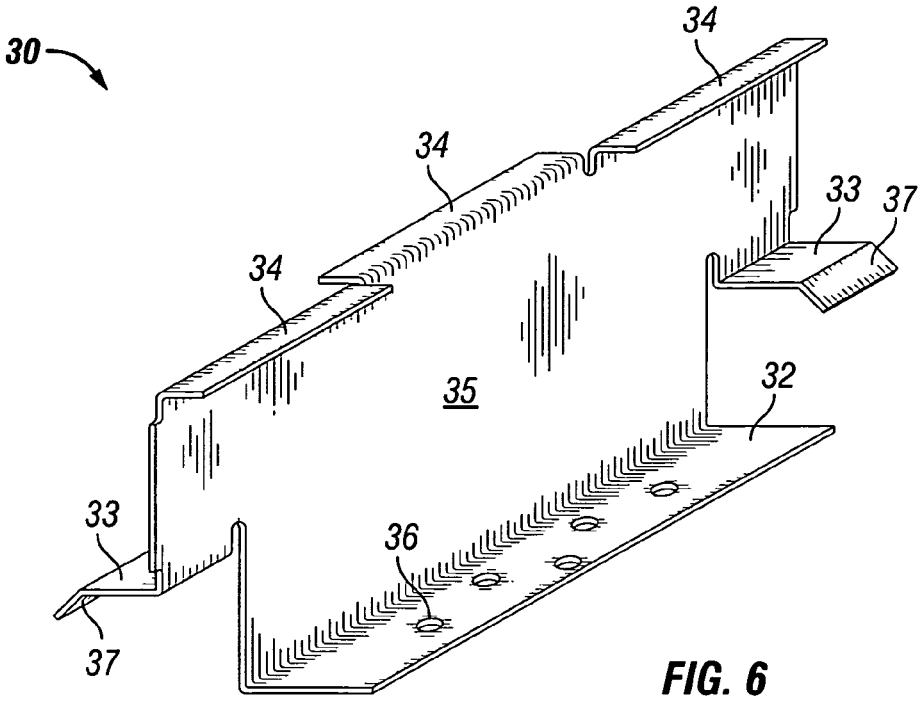
FIG. 6 is a perspective view of a preferred embodiment 30 of individual panel clips 30 of the subject invention, individual panel clip 30 being used in novel roof recover 10 shown in FIGS. 1-5.

More particularly, as shown more specifically in FIG. 6, individual clips 30 which are installed in field zones F and edge zones E include a bottom flange 32, shelf flanges 33, and top flanges 34 that extend generally horizontally from a vertically oriented web or body 35. Bottom flange 32 provides a base by which clips 30 are attached to existing roof 200 by, for example, driving screws 13 through existing panels 220 into existing purlins 201. Round apertures 36 preferably are provided in base 32 to accommodate screws or other fasteners, but if desired, slots may be provided, or screws may be driven through base 32.

The length of clips 30 and base 32 thereof, as well as the placement, configuration, and number of apertures 36, preferably are coordinated to allow for some imprecision in placement of clips 30 during installation while ensuring that a sufficient number of fasteners may be driven into existing purlins. It also is preferable that base 32 be sufficiently long so as to extend across the entire width of purlins so as to allow for a more stable and secure connection thereto. Also, while base 32 of clips 30 is formed from a continuous flange extending from body 35, other configurations are within the scope of the invention. For example, the base of an individual clip may be formed from two or more flanges extending alternately in opposite directions from the clip body.

Shelf flanges 33 have a first more or less horizontal portion which, along with top flanges 34, provides support for recover panels 20. Top flanges 34 also facilitate the formation of standing seams 21 between recover panels 20. That is, as best appreciated from the cross-sectional views of FIGS. 4-5, the lateral edges of panels 20 are bent upwards to provide upwardly extending sides 23 on both sides of trough 22. The upper portion of panel sides 23 is doubled over horizontally to form a narrow u-shaped channel 24 running vertically on top of each side 23 of panels 20. It will be noted that recover panels 20 are symmetrical, that is, their sides 23 are mirror images.

As recover panels 20 are installed, therefore, sides 23 of panels 20 will be supported on the top surfaces of shelf flanges 33 in adjacent lines of clips 30. At the same time, u-shaped channels 24 in the upper portion of sides 23 of panels 20 are slipped over top flanges 34. A seam cover 25 then is provided over and around the exterior of channels 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

The exact dimensions of shelf flanges and top flanges in the novel individual clips are not especially critical and may be varied somewhat to provide as much or as little support surface as may be desired or necessary for a particular installation. Likewise, clips 30 have three top flanges 34, two flanges 34 extending in one direction and one flange 34 extending in an opposite direction. Other clips, however, may be provided with any number of top flanges extending in alternating directions.

Figure 7:
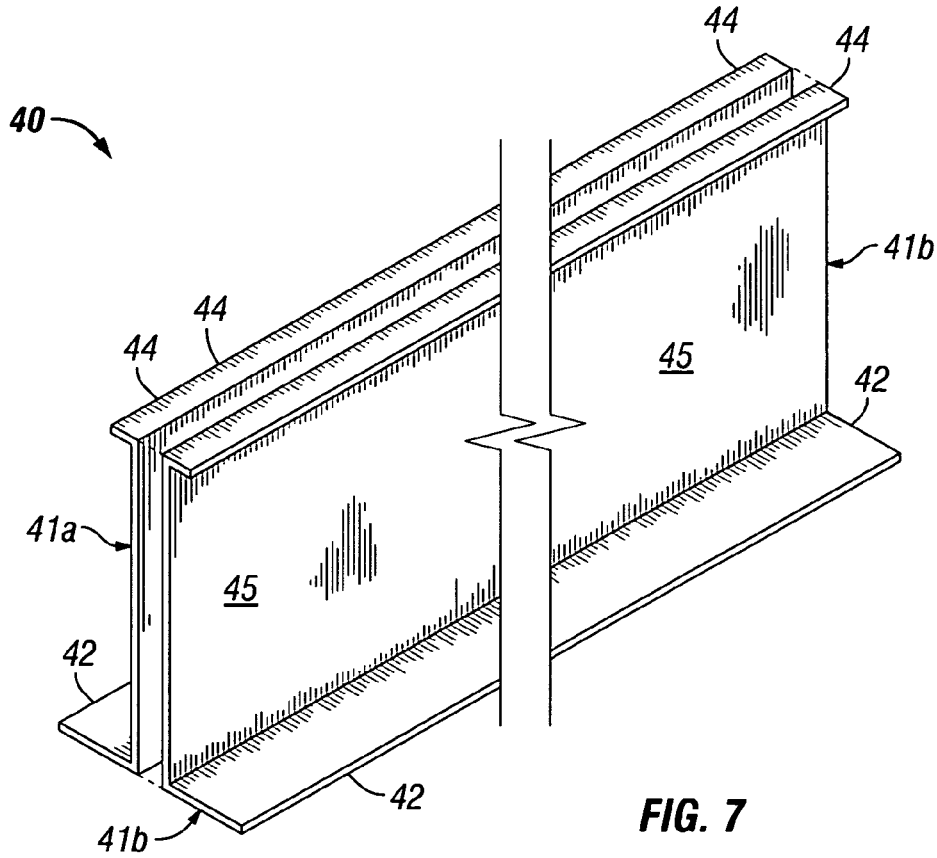
FIG. 7 is an exploded perspective view of a preferred embodiment 40 of continuous panel clips of the subject invention, continuous panel clip 40 being used in novel roof recover 10 shown in FIGS. 1-5.

Continuous clips 40, as seen best in FIG. 7, are formed from two identical components 41*a* and 41*b*. Clip components 41 have a generally c-shaped cross-section and are installed in back-to-back fashion such that the overall cross-section of continuous clips 40 is generally I-shaped. More particularly, clip components 41 have a bottom flange 42 and a top flange 44 extending generally horizontally from a vertically oriented web or body 45. Bottom flange 42 provides a base by which clips 30 are attached to existing roof 200 by, for example, driving screws 13 through existing panels 220 into existing purlins 201. The screws typically are driven through base 42 to simplify installation of continuous clips 40. If desired, however, holes, slots or other apertures may be provided in base 42 to accommodate the passage of fasteners. The length of clip components 41 is coordinated such that clips 40 span at least the distance between adjacent purlins 201 in existing roof 200, but preferably such that clips 40 extend across all purlins 201 in the corner zone of roof 200.

The width of base 42, as well as the placement, configuration, and number of any apertures present, preferably are coordinated to allow for some imprecision in placement of clip components 41 during installation while ensuring that a sufficient number of fasteners may be driven into existing purlins.

Top flanges 44 of continuous clips 40, similar to top flanges 34 in individual clips 30, engage adjacent panels 20 and assist in the formation of a standing seam 21 therebetween. More particularly, top flanges 44 are configured such that sides 23 of panels 20 may be engaged therewith by slipping u-shaped channels 24 around top flanges 44. Seam cover 25 then is placed over and around channels 24 to secure panels 20 to each other and to continuous clips 40. Sealants and seamers also are preferably used to form a secure, weather tight seam along continuous clips 40.

The clips used in the novel metal panel roof recovers preferably are made from steel, such as 16 to 24 gauge galvanized steel sheets that may be easily formed and bent and cut into a desired configuration by conventional metal forming equipment. Such materials provide a rugged, weather resistant clip that may be manufactured easily and economically. Continuous clips, given their length, may be made from somewhat lighter gage metal if desired to reduce costs and to more easily allow screws to be driven through the clip instead of providing apertures to accommodate fasteners. Other metals, such as extruded aluminum, may be used to fabricate the panel clips, however, as well as rigid, moldable or extrudable plastics.

Figure 8:
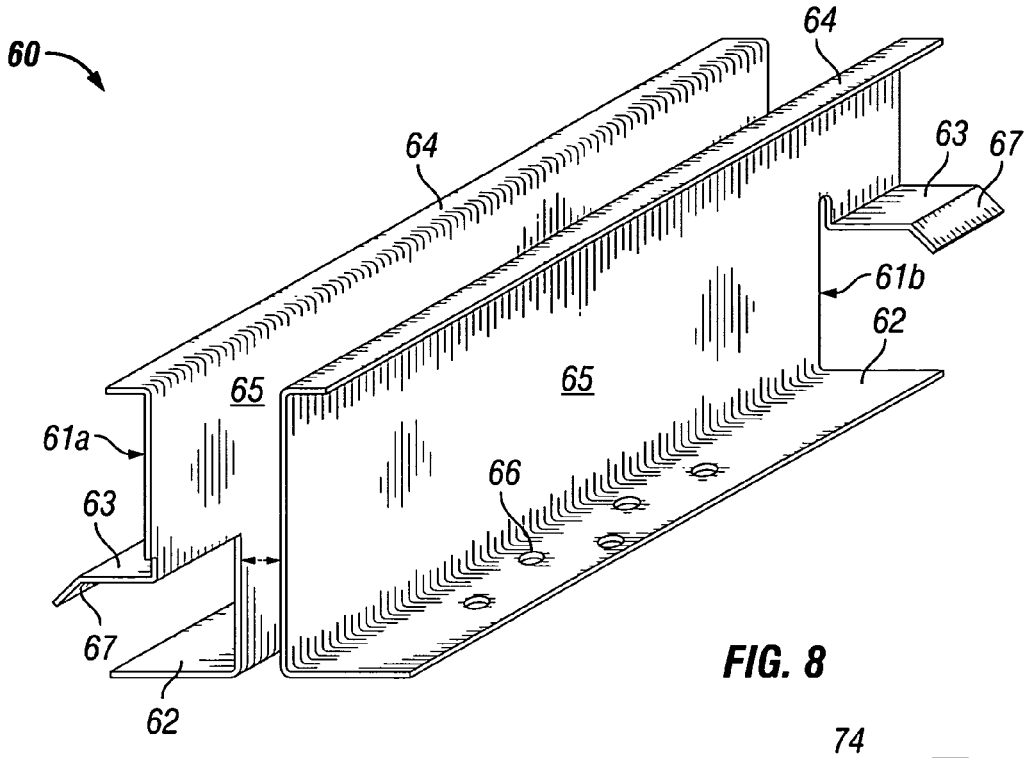
FIG. 8 is an exploded perspective view of a second preferred embodiment 60 of individual panel clips of the subject invention, which individual panel clip 60 may be used in novel roof recover 10 shown in FIGS. 1-5.
Figure 9:
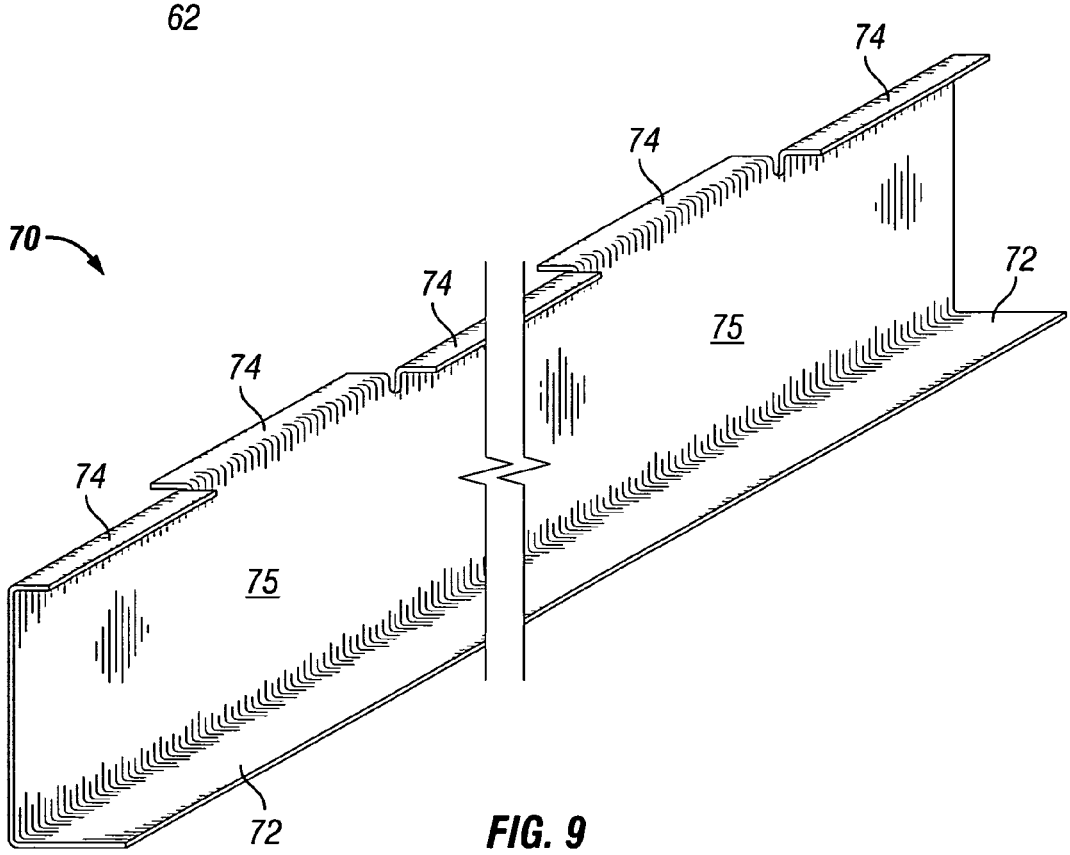
FIG. 9 is a perspective view of a second preferred embodiment 70 of continuous panel clips of the subject invention, which continuous panel clip 70 may be used in novel roof recover 10 shown in FIGS. 1-5.

Likewise, while individual clips 30 and continuous clips 40 are used in preferred embodiments of the novel roof recovers, the invention is not limited thereto. Other clip configurations may be used if desired. For example, while individual clips 30 in novel roof recover 10 are a unitary component, other individual clips suitable for use in other embodiments of the subject invention may have a two-piece design, similar to continuous clips 40, as shown in FIG. 8. Likewise, as shown in FIG. 9, continuous clip 40 may be fabricated as a unitary component, analogous to individual clips 30. The various flanges in the exemplified clips are integral with their associated clip body. If desired, however, the various flanges may be provided as separate components affixed to a clip body, e.g., by welding.

Alternately, continuous support for panel seams across adjacent purlins may be provided by providing a panel support member which straddles two individual clips across their shelf flanges. The panel support member may be attached and secured to individual clips by any means known in the art, such as glue, welding, or fasteners. The panel support member includes a substantially flat upper surface and a bent flange on each edge of the substantially flat upper surface. The substantially flat upper surface of the panel support member is configured to contact and support the recover panel, for example, by engaging u-shaped channels in a manner analogous to that described above. The panel support member essentially connects the individual clips and creates a support structure for the recover panels.

In accordance with various preferred embodiments, both the individual clips and continuous clips will be configured such that when recover panels are attached thereto space is created for the installation of insulation. When individual clips 30 are installed over existing roof 200, for example, body 35 is sufficiently elongated that shelf flanges 33 are situated somewhat above lap ridges 221 in existing panels 220 and, necessarily, well above shorter vertical ridges 226. Thus, when recover panels 20 are attached to individual clips 30, a clearance or space 50 is created between existing panels 220 and recover panels 20. Likewise, when panels 20 are attached to continuous clips 40, space 50 also will be provided above existing panels 220. Spaces 50 may be and preferably are filled with insulation.

The amount of space provided between the existing panels and recover panels and the choice of insulation may be coordinated to provide whatever level of thermal resistance for the cover that may be desired. When materials having higher thermal resistance are used, less space may be provided, and vice versa.

Any of the wide variety of insulating materials commonly used in building construction to reduce heat transfer by conduction, radiation, or convection may be used in the novel recover metal roofs. Such insulating materials include polyurethane, isocyanate, and other spray foam insulation, cotton, rock and slag wool, fiberglass, and other fibrous bats and blankets, cellulose and other blown-in fibrous insulation, and expanded or extruded closed cell polystyrene (EPS and XPS), polyisocyanate, and other rigid plastic foam insulation. Various barrier sheets, films, coatings, and facing also may be provided to provide additional thermal resistance, to minimize water condensation in the insulation, or to provide fire resistance to the insulation.

The choice of insulating materials will depend in large part on the degree of thermal resistance desired and cost considerations. At the same time, however, recover panels will be supported by panel clips only along their seams. Especially in the edge and corner zones, the panel clips provide relatively little support for the trough areas of the panels. Thus, insulation preferably is selected and installed so that it will provide support for the panels in their trough areas. That support preferably is sufficient to allow workers to walk over the recovered roof without causing the panels to sag to a degree that will make a worker uncomfortable or that will damage the seams between recover panels.

For example, in field zones F of recover roof 10 panels 20 are relatively resistant to sagging. Thus, as may be seen in FIG. 2, a fiberglass blanket 51 may be installed in space 50. Blanket 51 may be rolled between rows of clips 30. Alternately, slits may be provided in blanket 51 such that when it is laid over individual clips 30 they will extend through blanket 51 and allow panels 20 to be attached thereto. If desired, multiple layers of blankets may be laid crosswise (not shown) in space 50. In any event, shelf flange 33 and, in particular, a downwardly angled extension 37 thereof may assist in holding down blankets 51, or any other insulation components used in the roof recover, as they are installed. Since blankets 51 are easily compressed, they will conform to the dimensions and profile of space 50 once recover panels 20 are attached to clips 30.

Figure 10:
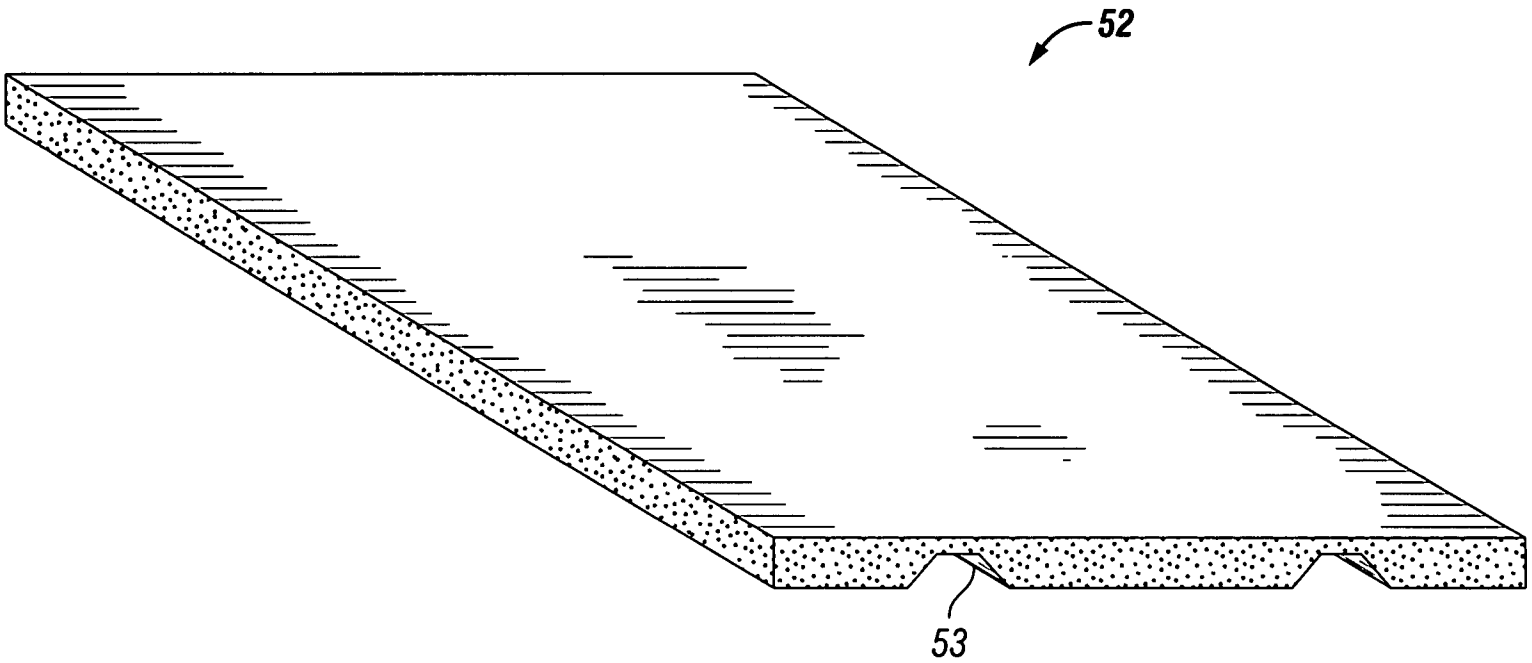
FIG. 10 is a perspective view of a preferred embodiment 52 of insulation which may be used in novel roof recover 10 shown in FIGS. 1-5.

Edge zones E and especially corner zones C of recover roof 10, however, have relative low load capacity. In the absence of supporting insulation, workers walking on recover panels 20 may damage seams 21. Thus, rigid insulation, such as rigid plastic foam boards 52 are provided in spaces 50 in the edge zones E and corner zones C as shown in FIG. 3. Foam boards 52, as may be seen in FIG. 10, have a generally flat, solid rectangular configuration such that they may be placed over existing panels 220 between adjacent rows of clips 30 and 40 with their sides closely abutting each other. The bottom surface 53 of foam board 52 preferably is profiled to mate more or less with the profile of existing panel 220. The bottom surface 53 of foam boards 52, therefor, will be able to rest more or less continuously across the surface of existing panels 220, thus allowing any load transmitted to the foam to be distributed across a wider area. Cutouts may be provided (not shown), if desired, to accommodate individual clips 30 and facilitate installation of foam boards 52. Wider foam boards spanning across seam lines also may be provided with openings to accommodate individual panel clips.

Foam boards 52 preferably are composed of relatively dense high load capacity rigid plastic foam, such as expanded or extruded closed cell polystyrene. They may comprise facing, such as various barrier sheets, films, and coatings designed to provide a vapor barrier, to reflect radiant heat, or to provide fire resistance, or they may be unfaced. Preferably, foam boards will have a load capacity of at least about 25 pounds per square inch (psi). If desired, however, a somewhat less dense, lower load capacity foam may be used in edge zones E, such as a foam having a load capacity of a least about 18 psi. Less dense foam may provide sufficient support in edge zones E while reducing costs somewhat, the cost of such foam insulation being directly correlated to its density. On the other hand, foam boards also may be provided in all or part of field zones F of recover roof 10 if additional load capacity in those zones is desired.

It will be appreciated that the novel standing seam roof recovers almost invariably require the use of other components to complete certain portions of a recover installation. For example, if the roof includes a number of different fields, ridge caps will be provided along the peak and hip lines of the roof, and specialized connectors may be required for their installation. Similarly, flashing may be installed in roof valleys and around projections through the roof. Facia and soffit components also may be installed along the eaves and gables of the roof. A wide variety of such components and installation methods are known in the art and may be used in the novel roof recovers.

Other preferred embodiments of the novel roof recovers comprise rigid foam insulation boards supported on an existing roof. A plurality of panel clips are supported either on the insulation boards, or on bearing plates supported on the insulation boards. The panel clips are mounted to the purlins in the existing roof by fasteners that extend through the insulation boards and, if present, the bearing plates. A metal cover is attached to the panel clips. The metal cover comprises a plurality of metal panels interconnected by vertical standing seams formed on the panel clips.

Figure 11:
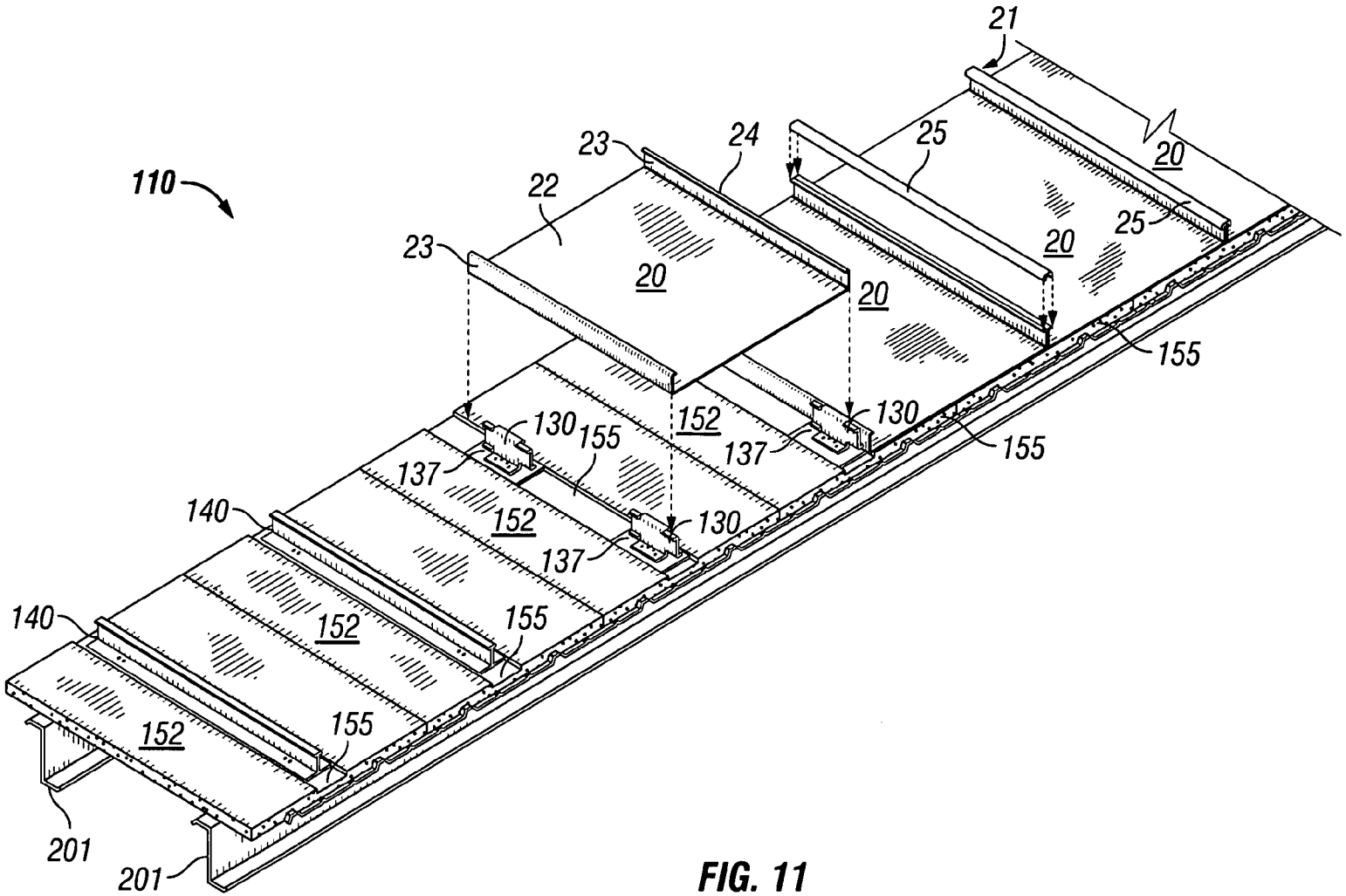
FIG. 11 is a partially exploded perspective view, similar to the view of FIG. 3, of a portion of a second preferred embodiment 110 of the metal panel roof recover systems of the subject invention, which portion of novel roof recover 110 has been installed across a boundary between edge zone E and corner zone C of conventional roof cover 200 (certain components of novel roof recover 110 having been omitted therefrom)

For example, another preferred embodiment of the subject invention, roof recover 110 shown in FIG. 11, generally comprises panels 20, individual clips 130, continuous clips 140, and foam boards 152. Recover metal roof 110 is installed over an existing roof, such as roof 200 shown in FIG. 1, in much the same fashion as is recover roof 10. Individual panel clips 130 are installed in the field zones F and edge zones E of roof 200, and continuous clips 140 are installed in the corner zones C of roof 200. Recover panels then are attached to clips 130 and 140. In recover roof 110, however, panel clips 130 and 140 are installed and supported on foam boards 152 with, if necessary, bearing plates 137 being provided under individual clips 130.

Figure 12:
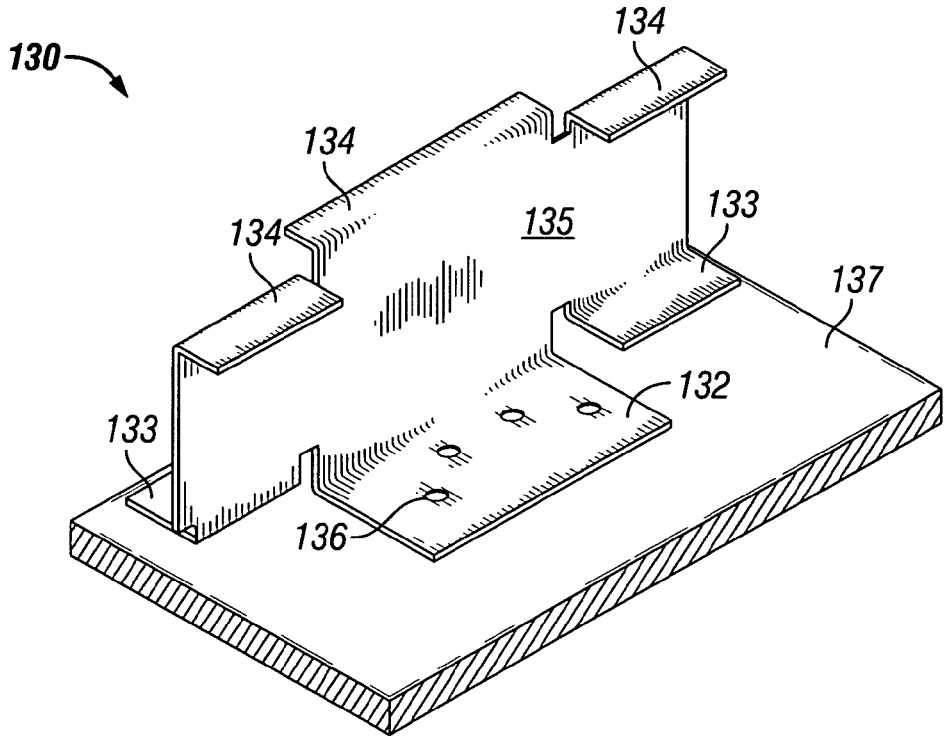
FIG. 12 is a perspective view of a third preferred embodiment 130 of individual panel clips of the subject invention, individual panel clip 130 being used in novel roof recover 110 shown in FIG. 11.

More particularly, as may be seen in FIG. 12, individual panel clips 130 are similar in construction to individual panel clips 30. Individual panel clips 130 include a bottom flange 132, shelf flanges 133, and top flanges 134 that extend generally horizontally from a vertically oriented web or body 135. Bottom flange 132 provides a base by which clips 130 are attached to existing roof 200 by, for example, driving screws 13 through foam board 152 and existing panels 220 into existing purlins 201. Apertures preferably are provided in base 132 to accommodate screws 13 or other fasteners, or if desired, screws 13 may be driven through base 132.

Individual panel clips 130 preferably are installed on bearing plates 137 interposed between clip base 132 and foam board 152. It will be appreciated that bottom flange 132 has a relatively small surface area, or at least a surface area which imparts excessive load to insulation materials commonly used in metal panel roofs. Bearing plate 137 significantly increases the surface area over which load from individual clips 130 is transferred to foam board 152. The size of the bearing plate 137 is coordinated with the load imparted to individual clips 130 and the load capacity of foam board 152.

It will be appreciated, however, that it may not always be necessary or desirable to mount individual clips on a foam insulation board using a bearing plate. Denser foam with higher load capacities may be used, but such foams are more expensive. The size of the clip base also may be increased to sufficiently distribute load to the foam insulation board. On the other hand, as compared to a taller clip that is supported on an existing panel, such as individual clip 30 used in recover roof 10, a clip mounted on top of an insulation board may be fabricated with significantly less metal. The clip itself is shorter and if a bearing plate is used, those material savings are not offset by any need to make the base of the clip larger or to use more expensive, denser foam. Moreover, bearing plates 137 may be made from relatively rigid, but relatively inexpensive material, such as scrap plywood, particle board, and OSB board. Thus, the bearing plates may be provided at lower material cost than enlarging the base of individual clips.

As in clips 30 used in novel recover roof 10, shelf flanges 133 of individual clips 130, along with top flanges 134, provides support for recover panels 20. Top flanges 134 also facilitate the formation of standing seams 21 between recover panels 20. That is, as panels 20 are installed, sides 23 of panels 20 will be supported on the top surfaces of shelf flanges 133 in adjacent lines of clips 130. At the same time, u-shaped channels 24 in the upper portion of sides 23 of panels 20 are slipped over top flanges 134. A seam cover 25 then is provided over and around the exterior of channels 24 to secure panels 20 to each other and to clips 130. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

Figure 13:
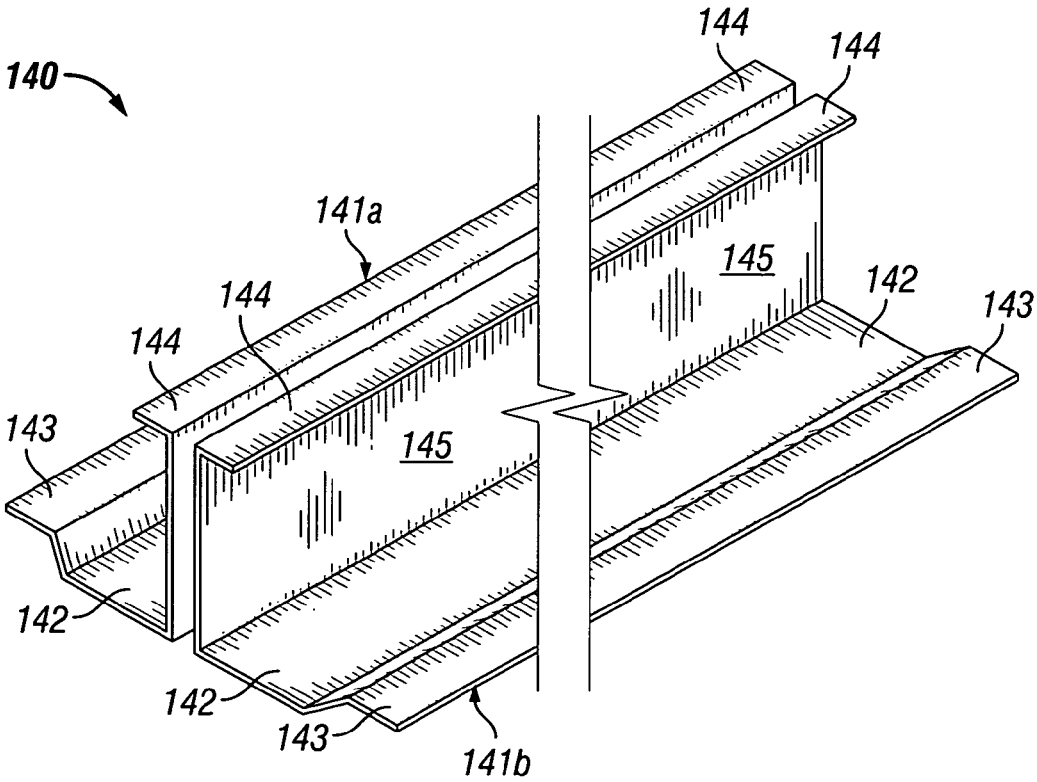
FIG. 13 is an exploded perspective view of a third preferred embodiment 140 of continuous panel clips of the subject invention, continuous panel clip 140 being used in novel roof recover 110 shown in FIG. 11.

Continuous panel clips 140, as may be seen in FIG. 13, are similar in construction to continuous panel clips 40. Continuous clips 140 also are formed from two identical components 141*a* and 141*b*. Clip components 141 have a vertically oriented web or body 145. A horizontal extension 142 at the lower end thereof provides a base by which clip components 141 are attached to existing roof 200 by, for example, driving screws 13 through foam board 152 and existing panels 220 into existing purlins 201. Screws 13 may be driven through base 142 or, if desired, apertures (not shown) may be provided in base 145 to accommodate screws 13 or other fasteners.

The length of clip components 141 is coordinated such that clips 140 span at least the distance between adjacent purlins 201 in existing roof 200, but preferably such that clips 140 extend across all purlins 201 in the corner zone of roof 200. The width of base 142, as well as the placement, configuration, and number of any apertures in base 142, preferably are coordinated to allow for some imprecision in placement of clip components 141 during installation while ensuring that a sufficient number of fasteners may be driven into existing purlins.

Because the load imparted to continuous clips already is distributed over a relatively large surface area, it may not be necessary provide bearing plates when continuous clips are supported over insulation boards. Bearing plates, however, may be used when continuous clips will be installed over insulation boards with relatively low load bearing capacities.

At the same time, it will be appreciated that the panels in many existing metal roofs are installed over relatively thick layers of insulation. The load capacity of such panels will be much less than that of panels mounted more or less directly to purlins. Thus, even when they will not be installed over insulation boards, the panel clips in various embodiments of the novel roof recovers may be installed with bearing plates.

Base 142 has an upwardly angled extending portion from which extends a horizontal shelf flange 143. Shelf flange 143, along with horizontally extending top flange 144, provides support for recover panels 20. Top flanges 144 also facilitate the formation of standing seams 21 between recover panels 20. As panels 20 are installed, sides 23 of panels 20 will be supported on shelf flanges 143 in adjacent lines of clips 140. At the same time, u-shaped channels 24 in the upper portion of sides 23 of panels 20 are slipped over top flanges 144. A seam cover 25 then is provided over and around the exterior of channels 24 to secure panels 20 to each other and to clips 140. Sealants and seamers also are preferably used to form a secure, weather tight seam along continuous clips 140.

The novel insulation boards are installed over the roof panels of an existing roof. They support panel clips above the roof panels, yet still allow the panel clips for recover panels to be mounted to the existing purlins. Thus, other factors being equal, the panel clips in such embodiments of the invention may be made shorter than equivalent clips designed to be supported on existing roof panels. Moreover, especially in installations where the existing roof has surface irregularities, as are commonly present when the existing panels ride on top of a relatively thick layer of insulation, mounting individual clips on top of insulation boards allow them to be aligned more easily. Preferably, the novel insulation boards are configured to not only accommodate the upper profile of existing panels, but also to accommodate the lower profile of panel clips and, if present, any bearing plates.

Figure 14:
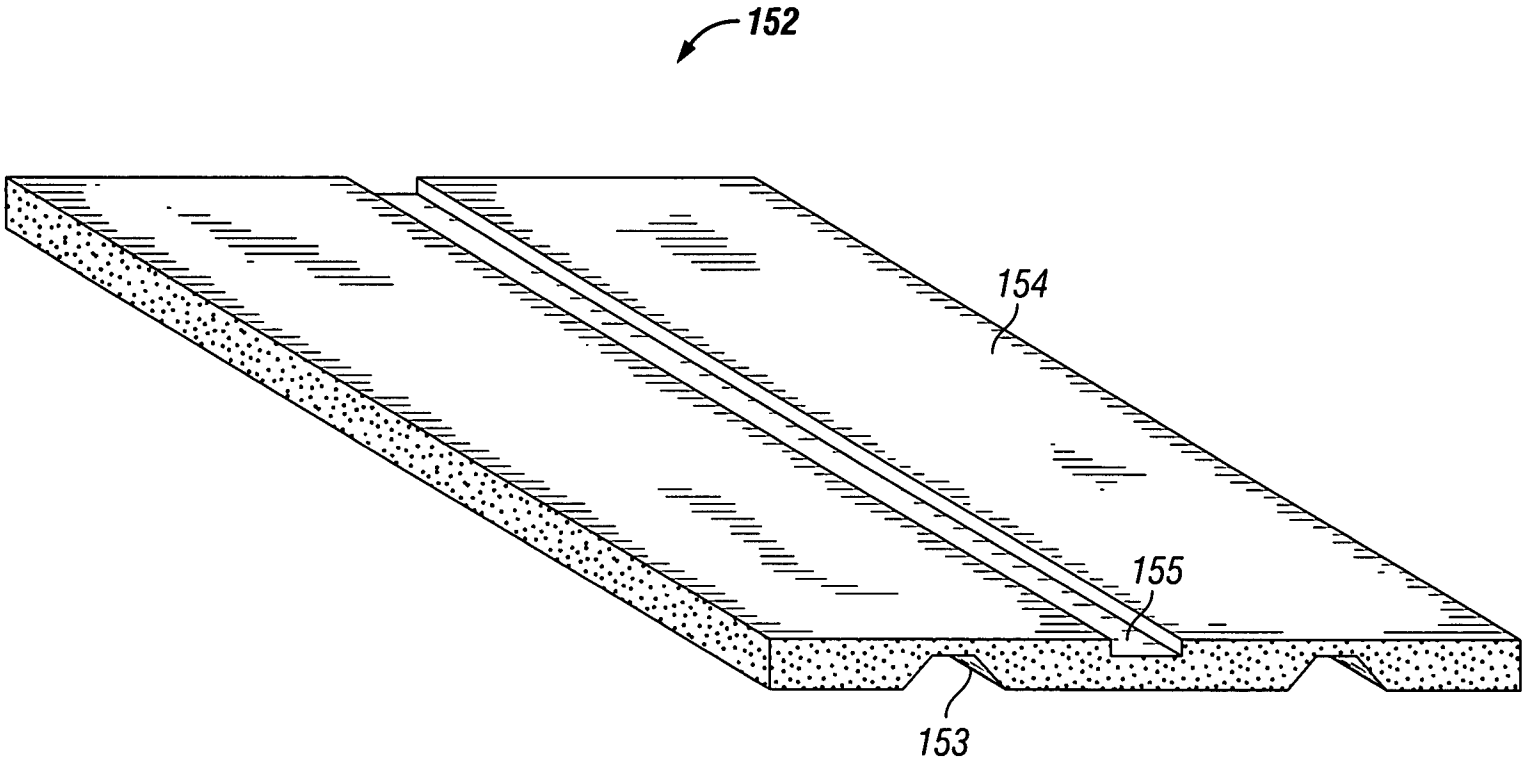
FIG. 14 is a perspective view of a preferred embodiment 152 of novel insulation members, insulation member 152 being used in novel roof recover 110 shown in FIG. 11.

For example, as shown in FIG. 14, foam boards 152 have a generally flat, solid rectangular configuration. Thus, a plurality of foam boards 152 may be tiled on the surface of existing roof 200, or some portion thereof, with their sides closely abutting each other. The lower surface 153 of foam board 152 is profiled to match the profile of existing roof panels 220. The upper surface 154 of foam board 152 is provided with a groove 155 running the length of foam board 152. Groove 155 is configured to accommodate panel clips 130 and their associated bearing plates 137 and continuous clips 140. That is, as will be appreciated from FIG. 11, the depth and width of groove 155 is such that bearing plates 137 and individual clips 130 may be placed therein with shelf flanges 133 of individual clips 130 being substantially at the same level as the upper surface 154 of foam board 152. Likewise, shelf flanges 143 of continuous clips 140 will be substantially even with foam board 152 when continuous clips 140 are placed in grooves 155. Thus, recover panels 20 will be supported across substantially the same plane.

The precise dimensions of the grooves in the novel insulation boards, of course, will be coordinated with the particular panel clips to be employed. Thus, the groove may vary in depth and width, and in its profile as required to accommodate the panel clips and, if present, bearing plates. Separate recesses also may be provided to accommodate individual clips and bearing plates, such as individual clips 130 and bearing plates 137.

The length and width of the insulation boards may be varied as desired, but generally the width will be coordinated with the width of the recover panels to be installed. Typically, the width will be equal to the width of the recover panel or some multiple thereof. Foam board 152, for example, has a width equal to the width of recover panels 20. Moreover, it will be appreciated that any grooves or arrays of separate recesses preferably will be located to allow indexing of the insulation boards and panel clips as they are installed. For example, groove 155 runs along the centerline of foam boards 152. Thus, when foam boards 152 are tiled across existing roof 200, grooves 155 will be spaced apart at a distance substantially equal to the width of recover panels 20. Installation of panel clips 130 and 140 may proceed more efficiently, the need for measuring and marking installation lines having been obviated.

While this invention has been disclosed and discussed primarily in terms of specific embodiments thereof, it is not intended to be limited thereto. Other modifications and embodiments will be apparent to the worker in the art.

What is claimed is:

1. A standing seam metal panel roof recover system installed over an existing roof having a pitch, said existing roof having a support frame which includes an array of spaced elongated support members running through said roof generally across said roof pitch and a plurality of interconnected metal panels mounted across said array of elongated support members generally along said roof pitch, said roof recover system comprising:

(a) individual standing seam panel clips arranged in linear arrays running generally along said roof pitch, each of said individual panel clips being mounted to a single said elongated support member by a fastener extending through said individual panel clip, said panels of said existing roof, and said elongated support member;

(b) elongated continuous standing seam panel clips, said continuous panel clips extending generally along said roof pitch, each of said continuous panels clips being mounted to at least two of said elongated support members by fasteners extending through said continuous panel clip, said panels of said existing roof, and said elongated support members;

(c) a metal cover attached to said standing seam clips, said metal cover comprising a plurality of standing seam metal recover panels having upwardly extending sides that define a trough between said sides, wherein facing said sides of adjacent said recover panels are connected on said clips to form a seam between said adjacent recover panels, said seam being elevated above said trough and running generally along said roof pitch, wherein said clips support said recover panels above said panels in said existing roof.

2. The roof recover system of claim 1, wherein said seams comprise a seam cover.

3. The roof recover system of claim 1, wherein said individual panel clips are installed in a field zone of said existing roof and said continuous panel clips are installed in an edge zone of said existing roof.

4. The roof recover system of claim 1, wherein said individual panel clips are installed in a field zone of said existing roof and said continuous panel clips are installed in a corner zone of said existing roof.

5. The roof recover system of claim 1, wherein said individual clips are supported on said panels in said existing roof.

6. The roof recover system of claim 1, wherein said roof recover system comprises:

(a) a rigid foam insulation board supported on said existing roof;

(b) wherein said individual, panel clips are supported on said insulation board and said fasteners mounting said individual panel clips to said elongated support members extend through said insulation board.

7. The roof recover system of claim 1, wherein said roof recover system comprises:

(a) a rigid foam insulation board supported on said existing roof;

(b) wherein said individual panel clips are supported on a bearing plate supported on said insulation board and said fasteners mounting said individual panel clips to said elongated support members extend through said bearing plate and said insulation board.

8. The roof recover system of claim 7, wherein said bearing plates are disposed in recesses provided in said insulation boards.

9. The roof recover system of claim 1, wherein said roof recover system comprises:

(a) a rigid foam insulation board overlaying said existing roof;

(b) wherein said continuous panel clips are supported on said insulation board and said fasteners mounting said continuous panel clips to said elongated support members extend through said insulation board.

10. The roof recover system of claim 9, wherein said continuous panel clips are supported in a groove provided in said insulation board.

11. A standing seam metal panel roof recover system installed over an existing roof having a pitch, said existing roof having a support frame which includes an array of spaced elongated support members running through said roof generally across said roof pitch and a plurality of interconnected metal panels mounted across said array of elongated support members generally along said roof pitch, said roof recover system comprising:

(a) rigid foam insulation boards supported on said existing roof;

(b) a plurality of standing seam panel clips supported on said insulation boards and arranged in arrays running generally along said roof pitch, said panel clips being mounted to said elongated support members by fasteners extending through said clips, said panels in said existing roof, said insulation boards, and said elongated support members; and (c) a metal cover attached to said panel clips, said metal cover comprising a plurality of standing seam metal recover panels having upwardly extending sides that define a trough between said sides, wherein facing said sides of adjacent said recover panels are connected on said panel clips to form a seam between said adjacent recover panels, said seam being elevated above said trough and running generally along said roof pitch.

12. The roof recover system of claim 11, wherein said panel clips are disposed in recesses in said upper surface of said insulation board.

13. The roof recover system of chum 12, wherein said metal clips are disposed in grooves provided in said upper surface of said insulation board.

14. The roof recover system of claim 11, wherein said roof panels of said existing roof have one or more raised ribs therein and said insulation boards have a lower profile matching said upper profile of said roof panels of said existing roof.

15. A standing seam metal panel roof recover system installed over an existing roof having a pitch, said existing roof having a support frame which includes an array of spaced elongated support members running through said roof generally across said roof pitch and a plurality of interconnected metal panels mounted across said array of elongated support members generally along said roof pitch, said roof recover system comprising:

(a) rigid foam insulation boards supported on said existing roof;

(b) a plurality of standing seam panel clips supported on bearing plates supported on said insulation boards, said panel clips being mounted to said elongated support members by fasteners extending through said bearing plates and said insulation boards; and (c) a metal cover attached to said panel clips, said metal cover comprising a plurality of standing seam metal recover panels having upwardly extending sides that define a trough between said sides, wherein facing said sides of adjacent said recover panels are connected on said panel clips to form a seam between said adjacent recover panels, said seam being elevated above said trough and running generally along said roof pitch.

16. The roof recover system of claim 15, wherein said bearing plates are disposed in recesses in said upper surface of said insulation board.

17. The roof recover system of claim 16, wherein said bearing plates are disposed in grooves provided in said upper surface of said insulation board.

18. The roof recover system of claim 15, wherein said roof panels of said existing roof have one or more raised ribs therein and said insulation boards have a lower profile matching said upper profile of said roof panels of said existing roof.

19. A method of installing a standing seam metal cover over an existing roof having a pitch, said existing roof having a support frame which includes an array of spaced elongated support members running through said roof generally across said roof pitch and a plurality of interconnected metal panels mounted across said array of elongated support members generally along said roof pitch, said method comprising:

(a) mounting individual standing seam panel clips to said elongated support members by installing a fastener through each said individual clip, said panels of said existing roof, and a single said elongated support member, said individual panel clips being arranged in linear arrays running generally along said roof pitch in a first area of said existing roof;

(b) mounting elongated standing seam continuous panel clips to said elongated support members by installing fasteners extending through each said continuous panel clip, said panels in said existing roof, and at least two said elongated support members, said continuous panel clips extending generally along said roof pitch in a second area of said existing roof;

(c) installing standing seam metal recover panels on said clips, said recover panels having upwardly extending sides that define a trough between said sides;

(d) interconnecting facing sides of adjacent said metal recover panels on said clips to provide a cover over said existing roof by connecting facing sides of adjacent said recover panels on said clips to form a seam between said adjacent recover panels, said seam being elevated above said trough and running generally along said roof pitch.

20. A method of installing a standing seam metal cover over an existing roof having a pitch, said existing roof having a support frame which includes an array of spaced elongated support members running through said roof generally across said roof pitch and a plurality of interconnected metal panels mounted across said array of elongated support members generally along said roof pitch, said method comprising:

(a) installing rigid foam insulation boards on said existing roof;

(b) mounting standing seam panel clips to said elongated support members by supporting said panel clips on said insulation boards and installing fasteners through said panel clips, said insulation boards, said panels of said existing roof, and said elongated support members;

(c) installing standing seam metal recover panels on said clips, said panels having upwardly extending sides that define a trough between said sides;

(d) interconnecting facing sides of adjacent said recover panels on said clips to provide a cover over said existing roof by connecting facing sides of adjacent said recover panels on said clips to form a seam between said adjacent recover panels, said seam being elevated above said trough and running generally along said roof pitch.

21. The roof recover system of claim 2, wherein said roof recover system comprises:

(a) a rigid foam insulation board supported on said existing roof;

(b) wherein said individual panel clips are supported on said insulation board and said fasteners mounting said individual panel clips to said elongated support members extend through said insulation board.

22. The roof recover system of claim 2, wherein said roof recover system comprises:

(a) a rigid foam insulation board supported on said existing roof;

(b) wherein said individual panel clips are supported on a bearing plate supported on said insulation board and said fasteners mounting said individual panel clips to said elongated support members extend through said hearing, plate and said insulation board.

23. The roof recover system of claim 2, wherein said roof recover system comprises:

(a) a rigid foam insulation board overlaying said existing roof;

(b) wherein said continuous panel clips are supported on said insulation board and said fasteners mounting said continuous panel clips to said elongated support members extend through said insulation board.

24. The roof recover system of claim 3, wherein said roof recover system comprises:

(a) a rigid foam insulation board supported on said existing roof;

(b) wherein said individual panel clips are supported on said insulation board and said fasteners mounting said individual panel clips to said elongated support members extend through said insulation board.

25. The roof recover system of claim 3, wherein said roof recover system comprises:

(a) a rigid foam insulation board supported on said existing roof;

(b) wherein said individual panel clips are supported on a bearing plate supported on said insulation board and said fasteners mounting said individual panel clips to said elongated support members extend through said bearing plate and said insulation board.

26. The roof recover system of claim 3, wherein said roof recover system comprises:

(a) a rigid foam insulation board overlaying said existing roof;

(b) wherein said continuous panel clips are supported on said insulation board and said fasteners mounting said continuous panel clips to said elongated support members extend through said insulation board.

27. The roof recover system of claim 4, wherein said roof recover system comprises:

(a) a rigid foam insulation board supported on said existing roof;

(b) wherein said individual panel clips are supported on said insulation board and said fasteners mounting said individual panel clips to said elongated support members extend through said insulation board.

28. The roof recover system of claim 4, wherein said roof recover system comprises:

(a) a rigid foam insulation board supported on said existing roof;

(b) wherein said individual panel clips are supported on a bearing plate supported on said insulation hoard and said fasteners mounting said individual panel clips to said elongated support members extend through said bearing plate and said insulation board.

29. The roof recover system of claim 4, wherein said roof recover system comprises:

(a) a rigid foam insulation board overlaying said existing roof;

(b) wherein said continuous panel clips are supported on said insulation board and said fasteners mounting said continuous panel clips to said elongated support members extend through said insulation board.

* * * * *

UNITED STATES PATENT AND TRADEMARK OFFICE

CERTIFICATE OF CORRECTION

PATENT NO. : 8,887,464 B1
APPLICATION NO. : 13/573282
DATED : November 18, 2014
INVENTOR(S) : Charles L. Smith, Jr.

It is certified that error appears in the above-identified patent and that said Letters Patent is hereby corrected as shown below:

In the Claims

In claim 6, at column 16, line 64, delete “,”.

In claim 13, at column 17, line 53, delete “chum 12” and insert therein -- claim 12 --.

In claim 22, beginning at column 19, line 27, delete “hearing, plate” and insert therein -- bearing plate --.

Signed and Sealed this
Tenth Day of March, 2015

Michelle K. Lee

Michelle K. Lee
*Deputy Director of the United States Patent and Trademark Office*